US007503404B2

(12) United States Patent
McDaniel et al.

(10) Patent No.: US 7,503,404 B2
(45) Date of Patent: Mar. 17, 2009

(54) METHODS OF WELL STIMULATION DURING DRILLING OPERATIONS

(75) Inventors: Billy W. McDaniel, Duncan, OK (US); Jim B. Surjaatmadja, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 354 days.

(21) Appl. No.: 10/824,024

(22) Filed: Apr. 14, 2004

(65) Prior Publication Data

US 2005/0230107 A1 Oct. 20, 2005

(51) Int. Cl.
*E21B 43/26* (2006.01)
*E21B 7/00* (2006.01)

(52) U.S. Cl. ..... 175/57; 166/308.1

(58) Field of Classification Search ..... 166/142, 166/305.1, 318, 308.1; 175/57, 230, 317, 175/324

See application file for complete search history.

(56) References Cited

U.S. PATENT DOCUMENTS

| | | | | |
|---|---|---|---|---|
| 3,233,676 | A * | 2/1966 | Lynes | 166/152 |
| 3,327,781 | A * | 6/1967 | Nutter | 166/264 |
| 3,529,665 | A * | 9/1970 | Malone | 166/264 |
| 3,578,078 | A * | 5/1971 | Shillander | 166/152 |
| RE27,459 | E * | 8/1972 | Guinn et al. | 166/250.01 |
| 5,111,881 | A * | 5/1992 | Soliman et al. | 166/250.1 |
| 5,765,642 | A | 6/1998 | Surjaatmadja | 166/297 |
| 6,006,838 | A * | 12/1999 | Whiteley et al. | 166/306 |
| 6,662,874 | B2 | 12/2003 | Surjaatmadja et al. | 166/308 |
| 2003/0083403 | A1 * | 5/2003 | Dawson et al. | 524/27 |
| 2005/0011678 | A1 * | 1/2005 | Akinlade et al. | 175/72 |
| 2008/0035341 | A1 * | 2/2008 | Saini et al. | 166/279 |

FOREIGN PATENT DOCUMENTS

WO WO 03/048508 A1 * 6/2003

OTHER PUBLICATIONS

Stimulation. (n.). Schlumberger Oilfield Glossary. Retrieved Mar. 7, 2008, from Schlumberger.com website: http://glossary.oilfield.slb.com.*

U.S. Appl. No. 10/807,986, entitled "Methods of Isolating Hydrajet Stimulated Zones".

* cited by examiner

*Primary Examiner*—David J Bagnell
*Assistant Examiner*—Robert E Fuller
(74) *Attorney, Agent, or Firm*—Robert A. Kent; Baker Botts LLP

(57) ABSTRACT

Present embodiments may include methods of stimulating a section of a subterranean formation comprising (a) forming at least a portion of a well bore that at least penetrates a section of the subterranean formation using a drilling operation; (b) stimulating a section of the subterranean; and (c) continuing the drilling operation Further, present embodiments may include methods of stimulating a section of a subterranean formation comprising (a) forming at least a portion of a well bore that at least penetrates a section of the subterranean formation using a drilling operation; (b) stimulating a section of the subterranean formation; and (c) continuing the drilling operation.

58 Claims, 6 Drawing Sheets

METHODS OF WELL STIMULATION DURING DRILLING OPERATIONS

BACKGROUND OF THE INVENTION

The present invention relates to subterranean well stimulation. More particularly, the present invention relates to improved methods of stimulating subterranean formations during drilling operations.

Drilling operations may include any suitable technique for forming a well bore that penetrates a subterranean formation. Examples of suitable techniques for forming a well bore may include, but are not limited to, rotary drilling and cable-tool drilling. Other techniques for forming a well bore may be used, but generally to a lesser extent. Rotary drilling operations typically involve attaching a drill bit on a lower end of a drill string to form a drilling tool and rotating the drill bit along with the drill string into a subterranean formation to create a well bore through which subsurface formation fluids may be produced. As the drill bit penetrates the subterranean formation, additional joints of pipe may be coupled to the drill string. In another method of drilling, coiled tubing may be used instead of jointed pipe and the drill bit may be rotated using a downhole motor. During drilling, drilling fluids may be used, inter alia, to lift or circulate formation cuttings out of the well bore to the surface and to cool the drill bit. Generally, after a well bore has been drilled to a desired depth, the drill string may be removed from the well bore and completion and/or stimulation operations may be performed. Completion operations may involve the insertion of steel pipe through the freshly drilled portion of the well bore. This pipe may be cemented into place by a set cement composition that has been pumped into the annulus between the wall of the well bore and the pipe (e.g., cemented casing), or the annulus may be left void (e.g., openhole liner). In some instances, the freshly drilled section, generally the producing zone of the subterranean formation, may be completed open hole. This may be true for vertical, inclined, or horizontal well bores. In some cases, the drilling string itself may be used as the well bore casing or liner.

Stimulation operations may be conducted on wells in hydrocarbon-bearing formations, inter alia, to increase a production rate or capacity of hydrocarbons from the formation. Stimulation operations also may be conducted in injection wells. One example of a stimulation operation is a fracturing operation, which generally involves injecting a fracturing fluid through the well bore into a subterranean formation at a rate and pressure sufficient to create or enhance at least one fracture therein, thereby producing or augmenting productive channels through the formation. The fracturing fluid may introduce proppants into these channels. Other examples of stimulation operations include, but are not limited to, acoustic stimulation, acid squeeze operations, fracture acidizing operations, and chemical squeeze operations. In an acoustic stimulation operation, high-intensity, high frequency acoustic waves may be used for near well bore cleaning. In a squeeze operation, the stimulation fluid is injected into the well bore at a rate and pressure sufficient to penetrate into the permeability of the formation, but below the pressure needed to create or enhance at least one fracture therein. In yet another stimulation operation, the creation of small fractures may be combined with chemical squeeze operations. In addition, stimulation operations also may include a variety acid wash operations, whereby a fluid is injected into the well bore, inter alia, to remove scale and/or other deposits from the formation face.

In some instances, it may be desirable to conduct stimulation operations in a freshly drilled well bore prior to placing the well into production due to low formation permeability and/or potential damage to the natural fractures in the hydrocarbon-producing zones of the formation due to drilling fluids, solids, or formation fines invading those fractures. Generally, conventional stimulation techniques require removing the drilling tool from the well bore prior to performing the stimulation operation and may or may not involve use a final step of installing a casing or uncemented liner. This may be inconvenient and uneconomical, inter alia, because it may require up to several days and expensive preparations.

SUMMARY OF THE INVENTION

The present invention relates to subterranean well stimulation. More particularly, the present invention relates to improved methods of stimulating subterranean formations during drilling operations.

In some embodiments, the present invention provides a method of stimulating a section of a subterranean formation comprising the steps of (a) forming at least a portion of a well bore that at least penetrates a section of the subterranean formation using a drilling operation; (b) stimulating a section of the subterranean formation; and (c) continuing the drilling operation.

In other embodiments, the present invention provides a method of stimulating a section of a subterranean formation comprising the steps of (a) providing a drill string that comprises a stimulation tool interconnected as a part of the drill string and a drill bit attached at an end of the drill string; (b) drilling at least a portion of the well bore using the drill string, wherein the well bore at least penetrates a section of the subterranean formation; and (c) stimulating a section of the subterranean formation using the stimulation tool.

In other embodiments, the present invention provides a method of stimulating at least one section of a subterranean formation during a drilling operation comprising the steps of (a) providing a drill string that comprises a stimulation tool interconnected as a part of the drill string and a drill bit attached at an end of the drill string; (b) drilling at least a portion of the well bore using the drill string, wherein the well bore at least penetrates a section of the subterranean formation; (c) stimulating a section of the subterranean formation using the stimulation tool; and (d) removing the drill string from the well bore.

The features and advantages of the present invention will be readily apparent to those skilled in the art upon a reading of the description of the exemplary embodiments which follows.

BRIEF DESCRIPTION OF THE DRAWINGS

A more complete understanding of the present disclosure and advantages thereof may be acquired by referring to the following description taken in conjunction with the accompanying drawings, wherein.

Figure 1:
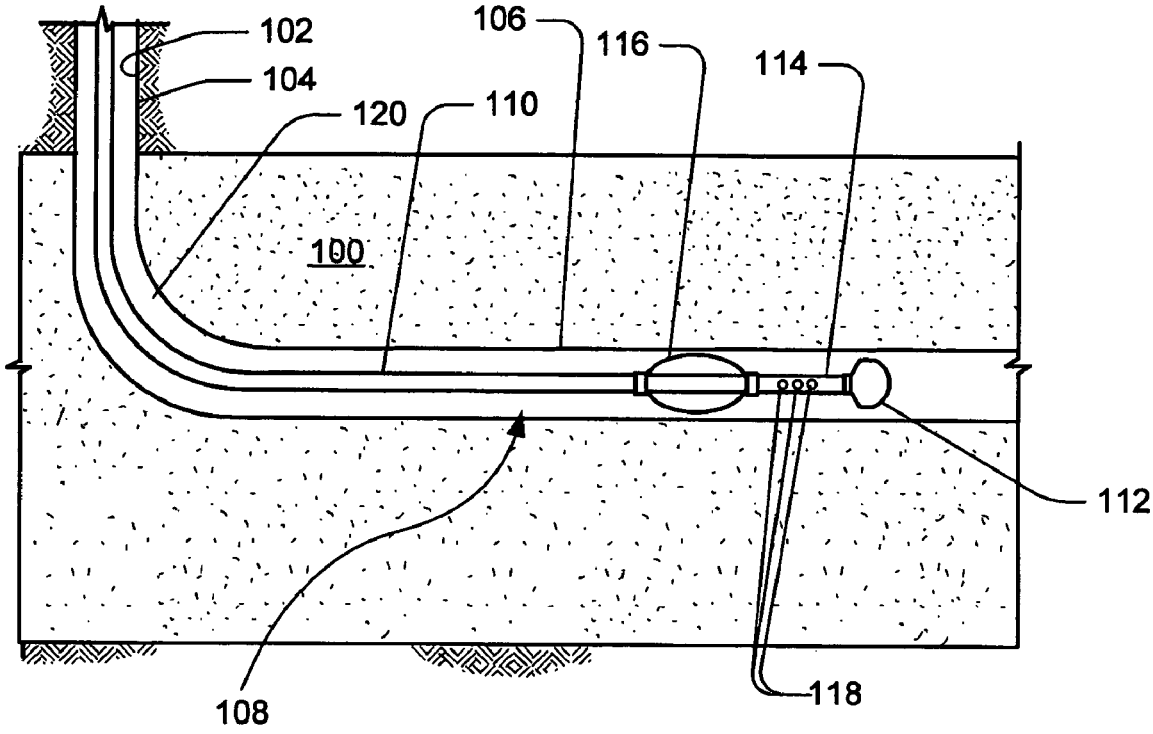
FIG. 1 illustrates a cross-sectional side view of a deviated or horizontal open hole well bore having a drill string disposed therein in accordance with an embodiment of the present invention.

While the present invention is susceptible to various modifications and alternative forms, specific exemplary embodiments thereof have been shown by way of example in the drawings and are herein described in detail. It should be understood, however, that the description herein of specific embodiments is not intended to limit or define the invention to the particular forms disclosed, but on the contrary, the intention is to cover all modifications, equivalents, and alternatives falling within the spirit and scope of the invention as defined by the appended claims.

DESCRIPTION OF EXEMPLARY EMBODIMENTS

The present invention relates to subterranean well stimulation. More particularly, the present invention relates to improved methods of stimulating subterranean formations during drilling operations. While the methods of the present invention are useful in a variety of applications, they may be particularly useful for stimulation operations in wells that will be completed openhole, with or without a liner. Among other things, the methods of the present invention may present a more cost-effective alternative to conventional stimulation operations, inter alia, because at least one trip in and out of a well may be saved according to the methods of the present invention.

In some embodiments, the present invention may provide methods of stimulating a section of a subterranean formation that comprise the steps of (a) forming at least a portion of a well bore that at least penetrates a section of the subterranean formation to be stimulated using a drilling operation; (b) stimulating a section of the subterranean formation; and (c) continuing the drilling operation.

According to the methods of the present invention, the step of forming a well bore in a subterranean formation may be performed using any suitable technique for forming a well bore that penetrates the subterranean formation. As referred to herein, the phrase "drilling operation" refers to forming a well bore in a subterranean formation using any suitable technique, including, but not limited to, rotary drilling, cable-tool drilling, hydrajet drilling, and laser drilling and also includes the removal of the drilling tools (e.g, drill bits) from the well bore where desired and may include renewal or replacement of the tool that is used to form the well bore. One of ordinary skill in the art, with the benefit of this disclosure, will be able to determine the appropriate drilling operation for a particular application based on a number of factors, including the desired depth of the well bore and formation characteristics and conditions.

In some embodiments, the drilling operation may include rotary drilling operations, wherein a drill string and a drill bit attached at an end of the drill string may be used to drill a well bore in a subterranean formation. Referring now to FIG. 1, subterranean formation 100 is illustrated penetrated by well bore 102. Well bore 102 includes generally vertical portion 104, which extends to the surface and generally horizontal portion 106, which extends into subterranean formation 100. Drill string 108 that comprises jointed pipe or coiled tubing 110, drill bit 112, stimulation tool 114, and optional conventional centralizer 116 is shown disposed in well bore 102. Drill bit 112 is connected at the lower end of drill string 108. Drill bit 112 may be any bit suitable for use in rotary drilling operations. Generally, centralizer 116 may be utilized where well bore 102 is deviated (e.g., horizontal), as shown in FIG. 1, inter alia, to radially centralize drill string 108 in well bore 102. Although one centralizer 116 is shown, any number or type of centralizers may be utilized in accordance with the methods of the present invention as desired by one skilled in the art. Stimulation tool 114 will be described in more detail below.

As in rotary drilling operations, at least a portion of well bore 102 may be formed by rotating drill bit 112 while adding additional joints of pipe or additional length of coiled tubing to drill string 108. In another embodiment (not shown), a drilling motor may be operatively connected to drill bit 112. In certain embodiments, it may not be necessary to rotate drill string 108 to rotate drill bit 112, e.g., by use of a drilling motor. Even though FIG. 1 depicts well bore 102 as a deviated well bore with generally horizontal portion 106, the methods of the present invention may be performed in generally vertical, inclined, or otherwise formed portions of wells. In addition, well bore 102 may include multilaterals, wherein well bore 102 may be a primary well bore having one or more branch well bores extending therefrom, or well bore 102 may be a branch well bore extending laterally from a primary well bore.

According to the methods of the present invention, after forming at least a portion of the well bore using a drilling operation, the step of stimulating a section of the subterranean formation should be performed. Stimulating the section of the subterranean formation may be accomplished using any suitable stimulation technique, including but not limited to, acoustic stimulation, fracturing operations, acid squeeze operations, fracture acidizing operations, chemical squeeze operations, acid wash operations, chemical wash operations, or any other technique designed to stimulate the section of the formation. One of ordinary skill in the art, with the benefit of this disclosure, will be able to determine the appropriate stimulation technique for a particular application depending on a number of factors, including the desired stimulation of the subterranean formation to be achieved and formation characteristics and conditions. Referring again to FIG. 1, once well bore 102 has been drilled to a desired depth, a section of subterranean formation 100 may be stimulated, for example, by using stimulation tool 114. In certain embodiments, the desired depth may be the desired measured depth of well bore 102, whereby stimulation of subterranean formation 100 may occur after formation of well bore 102. In these embodiments, the stimulation may occur multiple times at selected locations along well bore 102 as drill string 108 is being removed from well bore 102 following formation of well bore 102. In another embodiment, stimulation of subterranean formation 100 may occur only during a temporary cessation of drilling after reaching the desired depth for stimulation, thereafter drilling using drill string 108 may be resumed after the stimulation of subterranean formation 108 is performed.

Stimulation tool 114 may interconnected to drill string 108 by threaded connection (not shown) to jointed pipe or coiled tubing 110 and drill bit 112. While FIG. 1 depicts stimulation tool 114 interconnected to drill string 108 above drill bit 112, stimulation tool 114 may be interconnected to drill string 108 at any suitable location. Stimulation tool 114 may comprise ports 118 that may be opened and closed. While in the embodiments described herein stimulation tool 114 is a ported assembly, a wide variety of stimulation tools may be used dependent upon the particular application. In some embodiments, the stimulation tool may be an acoustic stimulation tool. One of ordinary skill in the art, with the benefit of this disclosure, will be able to determine the appropriate stimulation tool for a particular application.

Stimulation tool 114 should be positioned in well bore 102 adjacent to a section of subterranean formation 100 to be stimulated. In some embodiments, once stimulation tool 114 has been positioned adjacent to a section of subterranean formation 100 to be stimulated, a clean out of well bore 102 may be performed. To begin the clean out, a cleaning fluid may be introduced into well bore 102. In some embodiments, the cleaning fluid may be circulated into jointed pipe or coiled tubing 110, though stimulation tool 114, out through drill bit 112, and upwardly through annulus 120 between drill string 108 and the walls of well bore 102. In other embodiments, the cleaning fluid may be circulated down through annulus 120, and upwardly through drill bit 112, stimulation tool 114, and jointed pipe or coiled tubing 110. The cleaning fluid may be circulated for a desired time period, e.g., to clean out debris, cuttings, pipe dope, and other materials from inside drill string 108 and from well bore 102. Generally, the cleaning fluid may be any conventional fluid used to prepare a formation for stimulation, such as water-based or oil-based fluids. In some embodiments, these cleaning fluids may be combined with a gas, such as nitrogen, for a gas clean out. In some embodiments, the cleaning fluid may be designed so that it may have substantially the same chemistry as a drilling fluid. In these embodiments, the cleaning fluid may comprise an unweighted drilling fluid. One of ordinary skill in the art with the benefit of this disclosure will know the necessity for and duration of a clean out for a particular application.

After stimulation tool 114 has been positioned in well bore 102 adjacent to a section of subterranean formation 100 to be stimulated (or after the clean out has been performed), ports 118 should be opened and flow into the lower end of drill string 108 below the ports 118 of stimulation tool 114 should be stopped or severely limited. As those of ordinary skill in the art will appreciate, a number of mechanisms may be used to open the ports 118 and stop or limit the flow of which an exemplary mechanism will be described in more detail below. When the flow of fluid into the lower end of drill string 108 below ports 118 of stimulation tool 114 is stopped (or severely limited) and ports 118 are open, substantially all the stimulation fluid pumped down through jointed pipe or coiled tubing 110 and into stimulation tool 114 is forced out through ports 118. The stimulation fluid should be pumped through ports 118 for a period and at a rate sufficient to provide the desired stimulation of subterranean formation 100. In certain embodiments of the present invention, it may be desirable to stimulate multiple sections in subterranean formation 100. Accordingly, stimulation tool 114 may be moved to a second section of subterranean formation 100 to be stimulated, and the above procedure may be repeated to achieve the desired stimulation. As those of ordinary skill in the art will appreciate, the above procedure may repeated as desired.

Figure 2:
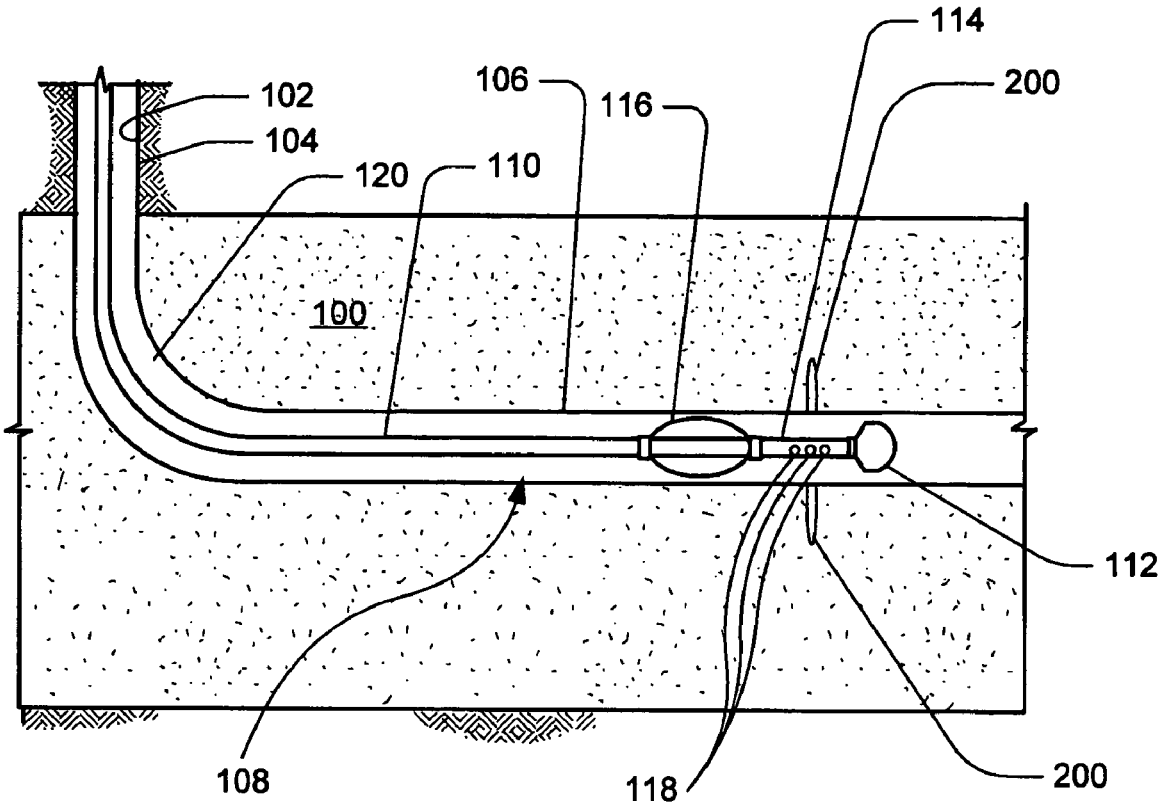
FIG. 2 illustrates a cross-sectional side view of a deviated open hole well bore having a drill string disposed therein after formation of a cavity in the subterranean formation in accordance with an embodiment of the present invention.

The stimulation fluid may be pumped down though jointed pipe or coiled tubing 110, through stimulation tool 114, and out through ports 118, at a wide variety of rates and pressures dependent, inter alia, on the desired stimulation of subterranean formation 100 to be achieved. For example, the stimulation fluid may be pumped into jointed pipe or coiled tubing 110 at a rate and pressure that will not penetrate the permeability of subterranean formation 100, at a rate and pressure that will penetrate the permeability of subterranean formation 100, or at a rate and pressure that will create or enhance at least one fracture in subterranean formation 100. Where used in acid and chemical wash operations, the stimulation fluid generally should be pumped into the jointed pipe or coiled tubing 110 at a rate and pressure such that the stimulation fluid is not injected into the section of subterranean formation 100. Alternatively, the stimulation fluid where used in squeeze operations, such as acid or chemical squeezes, may be pumped into the jointed pipe or coiled tubing 110 at a rate and pressure such that the stimulation fluid penetrates a section of subterranean formation 100, but below a rate and pressure sufficient to create or enhance at least one fracture therein. In another embodiment (e.g., hydrajetting operations), the rate and pressure of pumping the stimulation fluid into the jointed pipe or coiled tubing 110 may be increased to a level, whereby the pressure of the fluid, which is jetted through jet forming nozzles that may be connected in ports 118 against the section of subterranean formation 100, reaches a jetting pressure sufficient to cause the creation of at least one cavity 200 therein, as illustrated by FIG. 2.

A variety of stimulation fluids may be utilized in accordance with the methods of the present invention for stimulating subterranean formations, including, but not limited to, aqueous-based fluids, gases (e.g., nitrogen or carbon dioxide), or foamed fluids. Various additives may be included in the fluids used, such as abrasives (e.g., sand), a proppants (e.g., sand, man-made granules, naturally occurring granules, cellulosic materials and the like), acids, chemicals, and other additives known to those skilled in the art. In some embodiments, the proppant may be coated, e.g., with a resin or tackifier, for a specific function or purpose as desired by one skilled in the art. In some embodiments, the stimulation fluid may comprise an acid, such as hydrochloric acid or organic acids, inter alia, in an acid stimulation operation to dissolve formation material, or in an acid wash operation to remove scale and/or other deposits from the formation face. In another embodiment, the stimulation fluid may comprise chemicals, such as relative permeability modifiers that may modify the formation's permeability to water relative to oil. In particular, relative permeability modifiers may be used to reduce the water production from the subterranean formation, by reducing the water permeability therein. In some embodiments, the stimulation fluid may be designed so that it may have substantially the same chemistry as a drilling fluid. In these embodiments, the stimulation fluid may comprise an unweighted drilling fluid. One of ordinary skill in the appropriate skill in the art with the benefit of this disclosure will know the appropriate stimulation fluid and additives for a particular application.

In some embodiments, a second fluid may be pumped down annulus 120 before, simultaneously with, or after, the stimulation fluid is pumped into jointed pipe or coiled tubing 110. A variety of fluids may be utilized as the second fluid in accordance with the methods of the present invention, including, but not limited to, aqueous-based fluids, gases (e.g., air, carbon dioxide, or nitrogen), or foamed fluids. In some embodiments, it may be desirable to use a gas as the second fluid, for example, so that the second fluid will mix with the stimulation fluid to generate a foam downhole that acts to reduce fluid loss into subterranean formation 100. In some embodiments, the second fluid may be pumped down annulus 120 to enhance the stimulation of at least one cavity 200.

In other embodiments, annulus 120 may be shut in while the stimulation fluid is being pumped through ports 118, inter alia, to enhance the stimulation of subterranean formation 100. Generally, annulus 120 may be shut in so that sufficient pressure may be generated in well bore 102 adjacent to the section of subterranean formation 100 to be stimulated so that the desired stimulation may occur. One of ordinary skill in the art, with the benefit of this disclosure, will be able to determined the necessity for and the duration of the shut in of the annulus.

Figure 3:
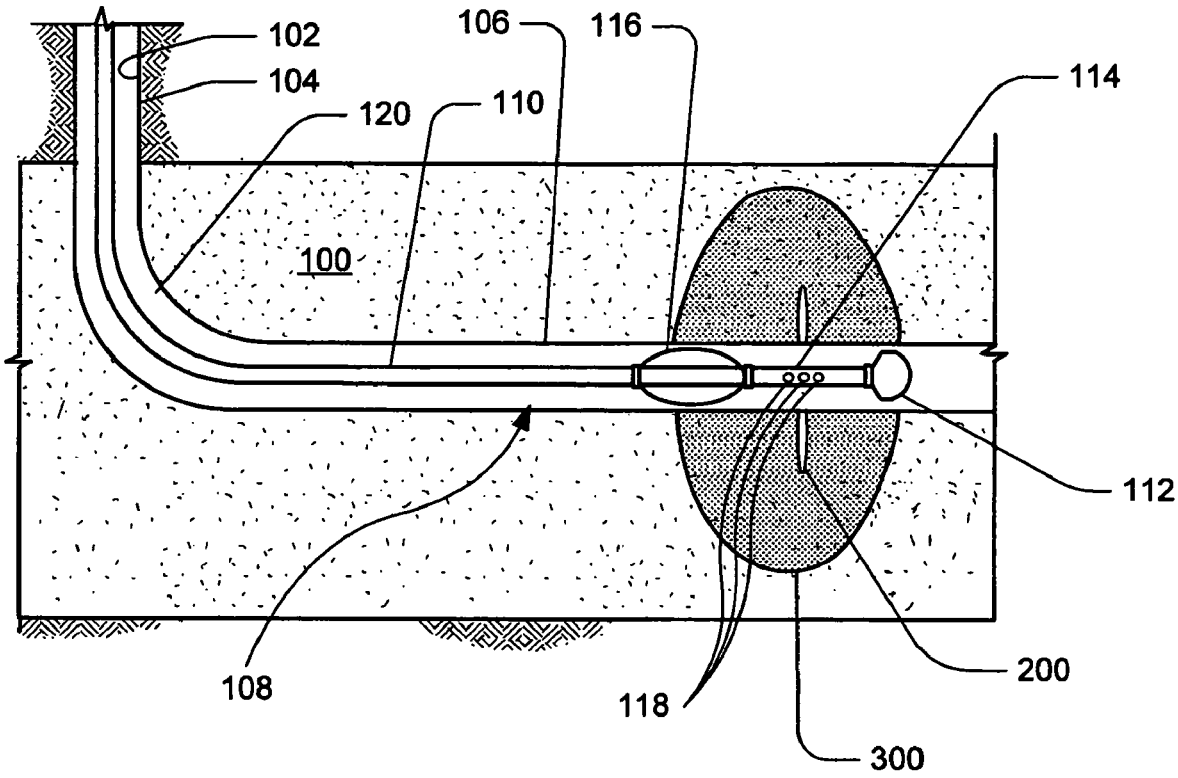
FIG. 3 illustrates a cross-sectional side view of a deviated open hole well bore having a drill string disposed therein after stimulation in accordance with an embodiment of the present invention, wherein an induced fracture occurs in an essentially vertical plane that is approximately parallel to the axis of the well bore.
Figure 4:
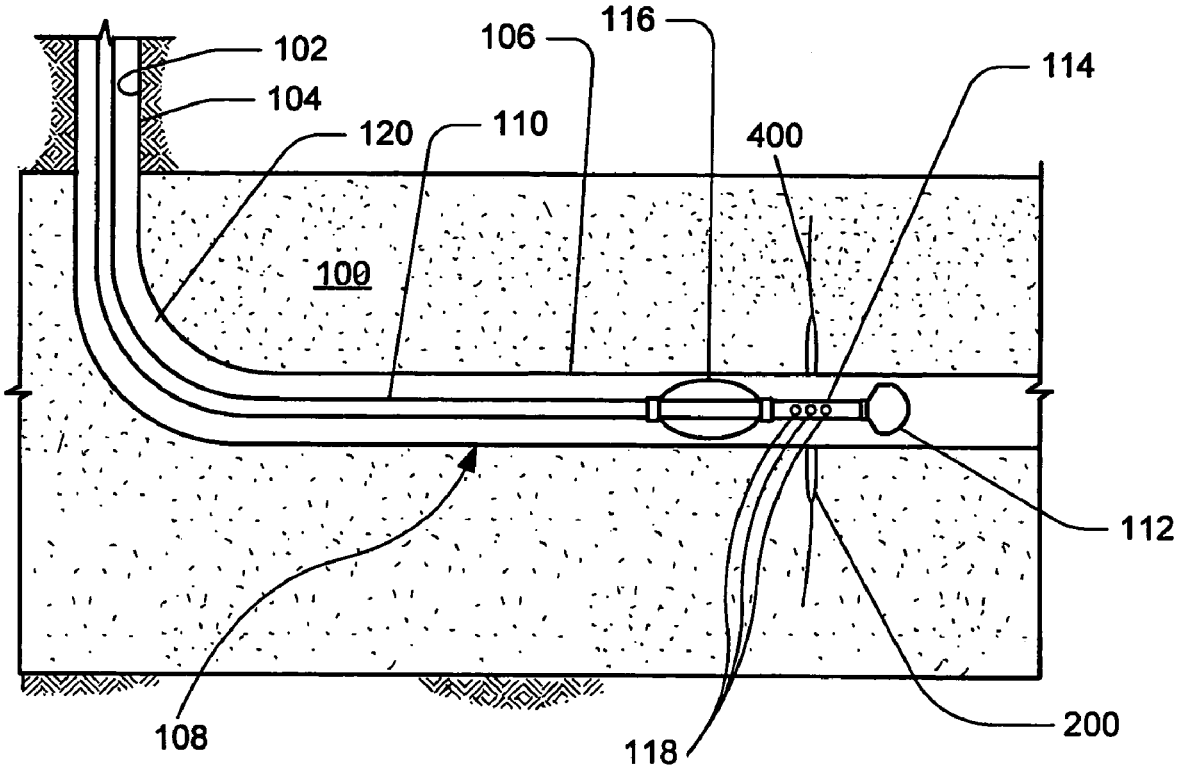
FIG. 4 illustrates a cross-sectional side view of a deviated open hole well bore having a drill string disposed therein after stimulation in accordance with an embodiment of the present invention, wherein an induced fracture occurs in an essentially vertical plane that is approximately perpendicular to the axis of the well bore.

Referring now to FIG. 2, an embodiment of a method of the present invention for fracturing a subterranean formation is illustrated. In this embodiment, jet forming nozzles (not shown) may be connected within ports 118 of stimulation tool 114 so that the stimulation fluid may be jetted against the section of subterranean formation 100 to be stimulated. Furthermore, ports 118 may or may not be disposed in a plane that is oriented perpendicular to or along the longitudinal axis of stimulation tool 114. Stimulation tool 114 should be positioned in well bore 102 adjacent to the section of subterranean formation 100 to be stimulated so that the plane containing ports 118 is aligned with the plane of maximum stress in the zone of subterranean formation 100. If desired, a cleaning fluid may be circulated through drill string 108 and back up annulus 120 as previously discussed. After positioning stimulation tool 114 in the section of subterranean formation 100 (or after the clean out has been performed), ports 118 may be opened and the flow into the lower portion of drill string 108 below ports 118 of stimulation tool 114 may be stopped or severely limited. Thereafter, stimulation fluid may be pumped down jointed pipe or coiled tubing 110, through stimulation tool 114, and jetted out through the jet forming nozzles connected within ports 118 against the section of subterranean formation 100 at a pressure sufficient to form at least one cavity 200 therein. In some embodiments, jetting the stimulation fluid against the section of subterranean formation 100 may further create at least one microfracture in the section of the subterranean formation 100 by ambient pressure plus stagnation pressure within at least one cavity 200. Referring now to FIGS. 3 and 4, simultaneously, with the jetting of the stimulation fluid against the section of subterranean formation 100, a second fluid may be pumped down annulus 120 at a rate sufficient to raise the ambient pressure in well bore 102 adjacent the section in subterranean formation 100 to be fractured to a level such that at least one cavity 200 and at least one microfracture fracture (if formed) may be enlarged and/or enhanced. In some embodiments, this forms at least one longitudinal fracture 300, as shown in FIG. 3, that extends in an essentially vertical plane that is approximately parallel to the axis of well bore 102. In other embodiments, this forms at least one transverse fracture 400, as shown in FIG. 4, that extends in an essentially vertical plane that is approximately perpendicular to the axis of well bore 102. One skilled in the art, with the benefit of this disclosure, will be able to determine the appropriate fracture extension, based, inter alia, on the subterranean formation characteristics and conditions and the desired stimulation of the subterranean formation. Exemplary methods of fracturing a formation while jetting are disclosed in U.S. Pat. No. 5,765,642, assigned to Halliburton Energy Services, Duncan, Okla., the relevant disclosure of which is incorporated herein by reference.

Figure 5:
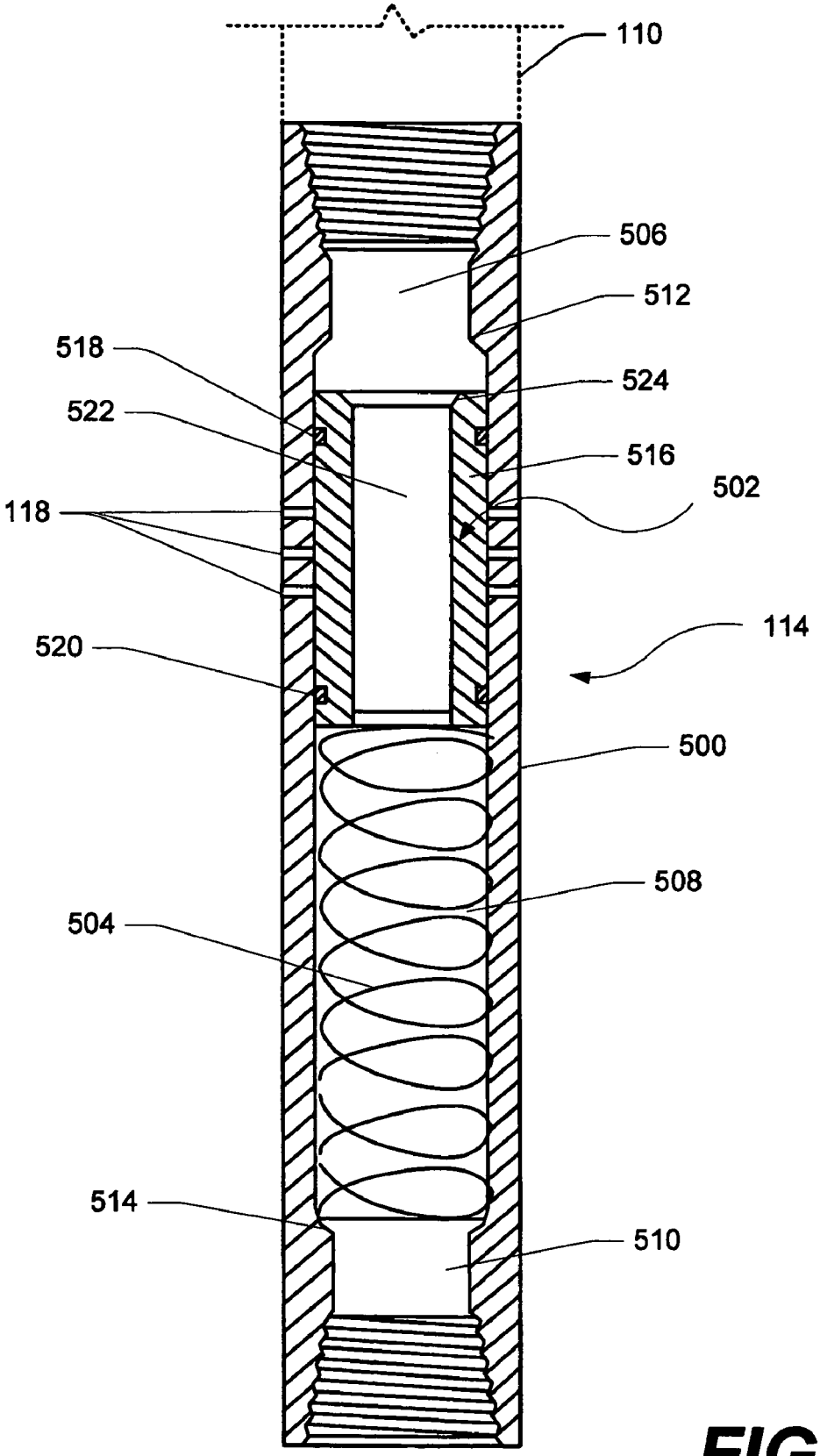
FIG. 5 illustrates a cross-sectional side view of a stimulation tool with a sliding sleeve in a first position that may be utilized in accordance with an embodiment of the present invention.

Referring now to FIG. 5, an embodiment of a stimulation tool for use in accordance with the methods of the present invention is illustrated and is shown generally by reference number 114. Generally, stimulation tool 114 may comprise housing 500 attachable to a drill string, such as drill string 108 (as shown in FIG. 1), by threaded connection to jointed pipe or coiled tubing 110. Stimulation tool 114 further may comprise valve means 502 slidably disposed within housing 500, and spring 504 disposed within housing 500 below valve means 502.

Housing 500 may comprise first bore 506 therein with slightly larger second bore 508 located below first bore 506, and third bore 510 located below second bore 508. First bore 506 may be substantially the same size as third bore 510. Downwardly facing shoulder 512 is defined between first bore 506 and second bore 508. Upwardly facing shoulder 514 is defined between first bore 506 and third bore 510. While housing 500 generally is depicted as a one-piece housing, in certain embodiments (not shown), housing 500 may be a multi-piece housing that comprises a ported subassembly and a valve subassembly connected to one end of the ported subassembly. A multi-piece housing may be desirable, inter alia, so that replacement of the ported subassembly may be performed independently of replacement of the valve subassembly. Furthermore, a multi-piece housing may allow construction of the ported subassembly with greater durability with respect to the valve subassembly. An example of a multi-piece housing that may be modified for use in the present invention is illustrated in U.S. Pat. Nos. 6,662,874 and 5,765,642, the relevant disclosures of which are hereby incorporated by reference.

Housing 500 further may comprise at least one port transversely extending therethrough. In some embodiments, housing 500 may have no ports therein when initially manufactured. When stimulation tool 114 is ready for use in the field, housing 500 may be drilled, machined, or otherwise modified to provide the desired number and pattern of the at least one port, depending on well conditions. For example, the at least one port may be defined by a plurality of ports 118 in generally evenly spaced rows as shown in FIG. 5. In another embodiment (not shown), the at least one port may be defined by a plurality of ports disposed in a spiral pattern around housing 500. In another embodiment, the at least one port may be defined by a plurality of ports disposed in a plane with respect to the longitudinal axis of stimulation tool 114. In some embodiments, a fluid jet forming nozzle (not shown) may be connected within the at least one port. In certain embodiments, the at least one port may be made of extremely hard material, such as carbide, threaded in housing 500. This may be beneficial, inter alia, when abrasive stimulation fluids are being used in the methods of the present invention.

In some embodiments, valve means 502 may be a sliding sleeve. For example, valve means 502 may comprise an elongated valve sleeve 516. The upper end of valve sleeve 516 should fit closely, but slidably, within second bore 508 of housing 500. A sealing mechanism, such as first O-ring 518, provides sealing engagement between housing 500 and the upper portion of valve sleeve 516. Another sealing mechanism, such as second O-ring 520, provides sealing engagement between housing 500 and the lower portion of valve sleeve 516. Valve sleeve 516 further may comprise valve bore 522 therethrough with an upwardly facing chamfered seat 524 at the upper end of valve bore 522.

FIG. 5 depicts valve means 502 in first position, wherein valve sleeve 516 covers ports 118 when valve means 502 is in its first position. First O-ring 518 and second O-ring 520 seal on the opposite side of ports 118 when valve means 502 is in its first position. When valve means 502 is in its first position, fluid may flow freely through into first bore 506, through second bore 508, and out through third bore 510.

Spring 504 may be disposed within second bore 508 of housing 500 below valve means 502. In certain preferred embodiments, spring 504 is a compression spring. Spring 504 should be of sufficient diameter so that it rests on upwardly facing shoulder 514, whereby downward movement of spring 504 may be limited by its engagement with upwardly facing shoulder 514. Spring 504 should be of sufficient length when expanded so that valve means 502 covers ports 118, and spring 504 should not compress due to pressure from valve means 502 or fluid pressure in jointed pipe or coiled tubing 110 until an actuating device is dropped into jointed pipe or coiled tubing 110.

Figure 6:
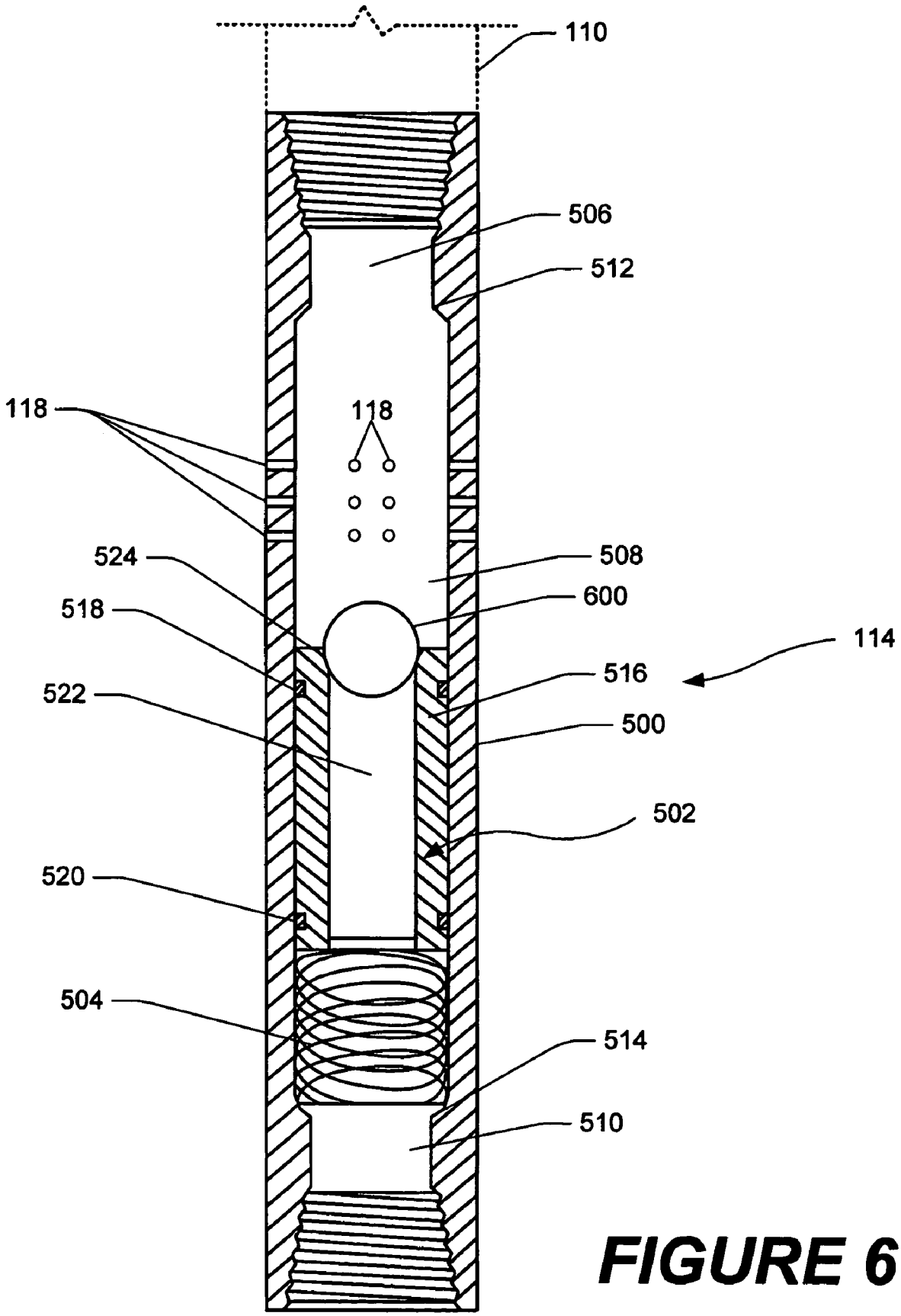
FIG. 6 illustrates a cross-sectional side view of a stimulation tool with a sliding sleeve in a second position that may be utilized in accordance with an embodiment of the present invention.

Referring now to FIG. 6, valve means 502 is illustrated in its second position. Valve means 502 may be converted to its second position by dropping a device into jointed pipe or coiled tubing 110 that is capable of compressing spring 504. A suitable example is ball 600. Ball 600 will engage on upwardly facing chamfered seat 524 of valve sleeve 516 and will substantially sealingly close second bore 508 of housing 500. Pressure applied in jointed pipe or coiled tubing 110 exerts a downward force on ball 600, compressing spring 504, and moving valve sleeve 516 so that valve means 502 is in its second position, as illustrated in FIG. 6. Generally, when valve sleeve 516 is in its second position, the downward pressure applied in jointed pipe or coiled tubing 110 may be sufficient to fully compress spring 504. When valve means 502 is in its second position, ports 118 are uncovered and placed in communication with second bore 508 of housing 500, whereby all the fluid pumped down through jointed pipe or coiled tubing 110 and into stimulation tool 114 exits stimulation tool 114 by way of ports 118. In the second position, sealing engagement is provided between the upper portion of valve sleeve 516 and the lower portion of housing 500 by first O-ring 518.

When it is desired to reverse circulate fluids through stimulation tool 114 and jointed pipe or coiled tubing 110 or to reclose ports 118, the pressure exerted within jointed pipe or coiled tubing 110 may be reduced, whereby higher pressure fluid surrounding stimulation tool 114 flows through drill bit 112 (not shown) and into stimulation tool 114, causing ball 600 to be pushed out of engagement with upwardly chamfered facing seat 524. When ball 600 unseats and the pressure is released, spring 504 expands moving valve sleeve 516 so that valve means 502 returns to its first position, wherein valve sleeve 516 covers ports 118

Even though FIGS. 5 and 6 depict using valve means 502 to open and close ports 118 and seal second bore 508 of housing 500, a wide variety of stimulation tool 114 designs may be suitable for the methods of the present invention. For example, ports 118 may be opened and closed by utilizing a variety of mechanical-activation mechanisms, such as a conventional shifting tool (not shown) conveyed into stimulation tool 114 on a wireline or slickline, or flow-activation mechanisms, such as by applying fluid pressure to drill string 108 to open or close the ports. In addition, other means known to those skilled in the art may be used in place of valve means 502 to prevent the flow of fluid through second bore 508 and force the fluid through ports 118.

According to the methods of the present invention, after the step of stimulating subterranean formation 100, the drilling operation may be continued. As those skilled in the art will appreciate, the step of continuing a drilling operation may include a variety of steps dependent on a number of factors, including the desired depth of the well bore. In some embodiments, continuation of the drilling operation may include resuming drilling of well bore 102 into subterranean formation 100. In other embodiments, continuation of the drilling operation may include removal of drill string 108 and drill bit 112 from well bore 102 where necessary. In some embodiments, it may not be desirable to remove drill bit 112 and drill string 108 from well bore 102, for example, where drill string 108 may be utilized as the well bore casing or liner or where drill bit 112 is to be disconnected from drill string 108 and dropped into well bore 102.

In certain embodiments of the present invention, it may be necessary to seal off the stimulated sections in subterranean formation 100. This may be necessary, inter alia, to prevent the flow of formation fluids from well bore 102 into the stimulated sections in subterranean formation 100, e.g., where drilling operations in well bore 102 may continue as heavier weight drilling fluids may damage these sections. For example, following the creation of fractures, such as at least one longitudinal fracture 300 or at least one transverse fracture 400, in the stimulated section of subterranean formation 100, the well bore entrance of such openings may be sealed off in a temporary manner. Exemplary methodology for sealing the stimulated section in subterranean formation during removal of drill string 108 from well bore 102 are disclosed in commonly owned U.S. patent application Ser. No. 10/807,986, the relevant disclosure of which is incorporated herein by reference. Similarly, it may be necessary to seal off well bore 102 after stimulation, for example, where well bore 102 branches from a primary well bore. Preferably, such branched well bore should be sealed at or near its intersection with the primary well bore, especially where drilling operations may continue in the primary well bore or another branch well bore.

A wide variety of techniques may be used to seal off the stimulated sections in subterranean formation 100. The stimulated sections of subterranean formation 100 may be sealed using a variety of materials, including, but not limited to, degradable sealants (e.g., degradable polymers), fluids (e.g., cement compositions or gels), solids, or combinations thereof. Suitable examples of degradable polymers that may be used as degradable sealants in conjunction with the present invention include, but are not limited to, polysaccharides, such as dextran or cellulose; chitins; chitosans; proteins; aliphatic polyesters; poly(lactides); poly(glycolides); poly(ε-caprolactones); poly(hydroxybutyrates); poly(anhydrides); aliphatic polycarbonates; ortho esters; poly(orthoesters); poly(amino acids); poly(ethylene oxides); and poly(phosphazenes). Other materials that undergo a degradation downhole also may be suitable, if the products of the degradation do not adversely affect other components. In certain preferred embodiments, the degradable sealant should not degrade until well bore 102 is produced. Examples of suitable solids include, but are not limited to, soluble solids, such as colemanite, paraffin beads, benzoic acid flakes, rock salt, and calcium carbonate. In some embodiments, combinations of these materials may be used. For example, poly(lactic acid) beads may be included in a gel, wherein the poly(lactic acid) beads with time degrade to form an acid that reduces the viscosity of the gel. The above-described materials should be removable during removal of drill string 108 from well bore 102 when drilling operations are complete or by separate operations during completion of well bore 102. Sealing of the branched well bore may be accomplished using the same methods discussed above. It is within the ability of one of ordinary skill in the art, with the benefit of this disclosure, to determine the appropriate means to seal off the stimulated section of subterranean formation 100 for a particular application.

In some embodiments, the present invention provides a method of stimulating a section of a subterranean formation comprising the steps of (a) forming at least a portion of a well bore that at least penetrates a section of the subterranean formation using a drilling operation; (b) stimulating a section of the subterranean formation; and (c) continuing the drilling operation.

In other embodiments, the present invention provides a method of stimulating a section of a subterranean formation comprising the steps of (a) providing a drill string that comprises a stimulation tool interconnected as a part of the drill string and a drill bit attached at an end of the drill string; (b) drilling at least a portion of the well bore using the drill string, wherein the well bore at least penetrates a section of the subterranean formation; and (c) stimulating a section of the subterranean formation using the stimulation tool.

In other embodiments, the present invention provides a method of stimulating at least one section of a subterranean formation during a drilling operation comprising the steps of (a) providing a drill string that comprises a stimulation tool interconnected as a part of the drill string and a drill bit attached at an end of the drill string; (b) drilling at least a portion of the well bore using the drill string, wherein the well bore at least penetrates a section of the subterranean formation; (c) stimulating a section of the subterranean formation using the stimulation tool; and (d) removing the drill string from the well bore.

Therefore, the present invention is well adapted to carry out the objects and attain the ends and advantages mentioned as well as those which are inherent therein. While numerous changes may be made by those skilled in the art, such changes are encompassed within the spirit of this invention as defined by the appended claims.

What is claimed is:

1. A method of fracturing a section of a subterranean formation comprising:

(a) forming at least a portion of a well bore that at least penetrates the subterranean formation using a drilling operation;

(b) selecting the section of the subterranean formation to fracture;

(c) fracturing the section of the subterranean formation using a stimulation tool interconnected with a drill string located in the portion of the well bore and used in the drilling operation, wherein the fracturing is initiated without removal of the drill string from the portion of the well bore after using the drill string to form the portion of the well bore, the fracturing comprising jetting a fracturing fluid through at least one port in the stimulation tool against the section of the subterranean formation at a pressure sufficient to create at least one cavity in the section of the subterranean formation; and (d) continuing the drilling operation.

2. The method of claim 1 wherein step (d) includes removing the drill string from the well bore.

3. The method of claim 1 wherein the drilling operation comprises at least one drilling operation selected from the group consisting of: a rotary drilling operation, a cable-tool drilling operation, a hydrajet drilling operation, and a laser drilling operation.

4. The method of claim 1 further comprising the step of pumping a second fluid into an annulus, wherein the annulus is formed between a wall of the well bore and a drill string that is disposed in the well bore.

5. The method of claim 4 wherein the second fluid is pumped into the annulus simultaneously with jetting the fracturing fluid.

6. The method of claim 1 further comprising the step of shutting an annulus, wherein the annulus is formed between a wall of the well bore and a drill string that is disposed in the well bore.

7. The method of claim 1 further comprising the step of introducing a cleaning fluid into the well bore.

8. The method of claim 1 wherein step (a) includes the use of a drilling fluid.

9. The method of claim 1 wherein the fracturing fluid comprises an unweighted drilling fluid.

10. The method of claim 1 wherein the fracturing fluid comprises at least one additive selected from the group consisting of: an abrasive, a proppant, an acid, a chemical, and any mixture thereof.

11. The method of claim 10 wherein the chemical is a relative permeability modifier.

12. The method of claim 1 wherein the fracturing fluid comprises at least one fluid selected from the group consisting of: an aqueous-based fluid, a gas, and a foamed fluid.

13. The method of claim 1 wherein a fluid jet forming nozzle is connected within the at least one port.

14. The method of claim 13 wherein the fracturing fluid is jetted through the fluid jet forming nozzle against the section of the subterranean formation at the pressure sufficient to form the cavity in the section of the subterranean formation.

15. The method of claim 14 further comprising the step of pumping a second fluid into an annulus to enhance the fracture of the cavity, wherein the annulus is formed between a wall of the well bore and a drill string that is disposed in the well bore.

16. The method of claim 15 wherein the second fluid is pumped into the annulus at a rate sufficient to raise the ambient pressure in the well bore adjacent to the section of the subterranean formation to a level sufficient to enhance the fracture of the cavity in the section.

17. The method of claim 14 further comprising the step of shutting an annulus, wherein the annulus is formed between a wall of the well bore and a drill string that is disposed in the well bore.

18. The method of claim 1 further comprising the step of opening the at least one port prior to the step of jetting the fracturing fluid through the at least one port.

19. The method of claim 18 wherein the step of opening the at least one port includes a sliding sleeve.

20. The method of claim 18 wherein the step of opening the at least one port includes a mechanical-activation mechanism or a flow-activation mechanism.

21. The method of claim 1 further comprising the steps of:

positioning the stimulation tool in the well bore adjacent to a second section of the subterranean formation to be fractured; and flowing the fracturing fluid through the at least one port to stimulate the second section of the subterranean formation.

22. The method of claim 1 further comprising the step of sealing the zone in the subterranean formation that was fractured.

23. The method of claim 22 wherein the step of sealing the zone in the subterranean formation that was fractured includes the use of at least one material selected from the group consisting of: a degradable sealant, a fluid, a solid, and any combination thereof.

24. The method of claim 23 wherein the fluid comprises at least one fluid selected from the group consisting of: a cement composition and a gel.

25. The method of claim 23 wherein the solid comprises at least one degradable solid selected from the group consisting of: colemanite, a benzoic acid flake, rock salt, a paraffin bead, and calcium carbonate.

26. The method of claim 23 wherein the degradable sealant comprises at least one degradable material selected from the group consisting of: a polysaccharide; a chitin; a chitosan; a protein; an aliphatic polyester; a poly(lactide); a poly(glycolide); a poly(ε-caprolactone); a poly(hydroxybutyrate); a poly(anhydride); an aliphatic polycarbonate; an ortho ester; a poly(orthoester); a poly(amino acid); a poly(ethylene oxide); and a poly(phosphazene).

27. The method of claim 1 wherein fracturing the section of the subterranean formation comprising jetting the fluid against the subterranean formation to fracture the section of the subterranean formation by ambient pressure plus stagnation pressure within the at least one cavity.

28. The method of claim 27 wherein fracturing the section of the subterranean formation comprises pumping a second fluid into an annulus between the drill string and the subterranean formation at a pressure sufficient to enlarge the fracture in the section of the subterranean formation.

29. The method of claim 1 wherein fracturing the section of the subterranean formation comprises pumping a second fluid into an annulus between the drill string and the subterranean formation at a pressure sufficient to enlarge the at least one cavity in the section of the subterranean formation.

30. The method of claim 1 wherein fracturing the section of the subterranean formation comprises pumping a second fluid into an annulus between the drill string and the subterranean formation at a pressure sufficient to raise the ambient pressure in the well bore adjacent the section of the formation to a level sufficient to enlarge the at least one cavity in the section of the subterranean formation.

31. A method of fracturing a subterranean formation comprising:

(a) providing a drill string that comprises a stimulation tool interconnected as a part of the drill string and a drill bit attached at an end of the drill string;

(b) drilling at least a portion of the well bore using the drill string, wherein the well bore penetrates the subterranean formation;

(c) selecting multiple sections of the subterranean formation to fracture; and (d) fracturing the multiple sections of the subterranean formation using the stimulation tool as the drill string is removed from the well bore.

32. The method of claim 31 wherein fracturing the multiple sections of the subterranean formation comprises at least one stimulation operation selected from the group consisting of: a fracturing operation and a fracture acidizing operation.

33. The method of claim 31 wherein the stimulation tool comprises at least one port.

34. The method of claim 33 wherein fracturing the multiple sections of the subterranean formation comprises the steps of:

positioning the stimulation tool in the well bore adjacent to a first section of the subterranean formation to be fractured; and flowing a fracturing fluid through the at least one port so as to fracture the first section of the subterranean formation.

35. The method of claim 34 further comprising the step of pumping a second fluid into an annulus, wherein the annulus is formed between a wall of the well bore and the drill string.

36. The method of claim 35 wherein the second fluid is pumped into the annulus simultaneously with jetting the fracturing fluid.

37. The method of claim 34 further comprising the step of shutting an annulus, wherein the annulus is formed between a wall of the well bore and a drill string that is disposed in the well bore.

38. The method of claim 34 further comprising the step of introducing a cleaning fluid into the well bore.

39. The method of claim 34 wherein step (b) includes the use of a drilling fluid.

40. The method of claim 34 wherein the fracturing fluid comprises an unweighted drilling fluid.

41. The method of claim 34 wherein the fracturing fluid comprises at least one additive selected from the group consisting of: an abrasive, a proppant, an acid, a chemical, and any mixture thereof.

42. The method of claim 34 wherein the fracturing fluid comprises at least one fluid selected from the group consisting of: an aqueous-based fluid, a gas, and a foamed fluid.

43. The method of claim 34 wherein a fluid jet forming nozzle is connected within the at least one port.

44. The method of claim 43 wherein the fracturing fluid is jetted through the fluid jet forming nozzle against the section of the subterranean formation at a pressure sufficient to form a cavity in the section of the subterranean formation.

45. The method of claim 44 further comprising the step of pumping a second fluid into an annulus to enhance the fracture of the cavity, wherein the annulus is formed between a wall of the well bore and the drill string.

46. The method of claim 45 wherein the second fluid is pumped into the annulus at a rate sufficient to raise the ambient pressure in the well bore adjacent to the section in the subterranean formation to a level sufficient enhance the fracture of the cavity.

47. The method of claim 44 further comprising the step of shutting an annulus, wherein the annulus is formed between a wall of the well bore and a drill string that is disposed in the well bore.

48. The method of claim 34 further comprising the step of opening the at least one port prior to flowing the fracturing fluid through the at least one port.

49. The method of claim 48 wherein the step of opening the at least one port includes a sliding sleeve.

50. The method of claim 48 wherein the step of opening the at least one port includes a mechanical-activation mechanism or a flow-activation mechanism.

51. The method of claim 34 wherein fracturing the multiple sections of the subterranean formation further comprises the steps of:

positioning the stimulation tool in the well bore adjacent to a second section of the subterranean formation to be fractured; and flowing the fracturing fluid through the at least one port to fracture the second section of the subterranean formation.

52. The method of claim 31 further comprising the step of sealing the section of the subterranean formation that was fractured.

53. The method of claim 52 wherein the step of sealing the section of the subterranean formation that was fractured includes the use of at least one material selected from the group consisting of: a degradable sealant, a fluid, a solid, and any combination thereof.

54. A method of fracturing at least one section of a subterranean formation during a drilling operation comprising:

(a) providing a drill string that comprises a stimulation tool interconnected as a part of the drill string and a drill bit attached at an end of the drill string;

(b) drilling at least a portion of the well bore using the drill string, wherein the well bore at least penetrates the subterranean formation;

(c) selecting the section of the subterranean formation to fracture;

(d) fracturing the section of the subterranean formation using the stimulation tool, the fracturing comprising jetting a fracturing fluid through at least one fluid jet forming nozzle in the stimulation tool against the section of the subterranean formation at a pressure sufficient to create at least one fracture in the section of the subterranean formation; and (e) removing the drill string from the well bore.

55. The method of claim 54 wherein fracturing the section of the subterranean formation comprises pumping a second fluid into an annulus between the drill string and the subterranean formation at a pressure sufficient to enlarge the at least one fracture in the section of the subterranean formation.

56. The method of claim 54 wherein fracturing the section of the subterranean formation comprises pumping a second fluid into an annulus between the drill string and the subterranean formation at a pressure sufficient to raise the ambient pressure in the well bore adjacent the section of the formation to a level sufficient to enlarge the at least one fracture in the section of the subterranean formation.

57. The method of claim 54 wherein fracturing the section of the subterranean formation comprises pumping a second fluid into an annulus between the drill string and the subterranean formation at a pressure sufficient to enlarge the at least one fracture in the section of the subterranean formation, wherein the second fluid is introduced into the annulus while the stimulating fluid is jetted against the section of the subterranean formation.

58. The method of claim 54 wherein fracturing the section of the subterranean formation comprises pumping a second fluid into an annulus between the drill string and the subterranean formation at a pressure sufficient to enlarge the at least one cavity in the section of the subterranean formation, wherein the second fluid is introduced into the annulus while the fracturing fluid is jetted against the section of the subterranean formation.

* * * * *